US008671467B2

(12) United States Patent
Tack et al.

(10) Patent No.: US 8,671,467 B2
(45) Date of Patent: Mar. 18, 2014

(54) HEAD PROTECTION SYSTEM

(75) Inventors: David W. Tack, Guelph (CA); Harold A. Angel, Guelph (CA)

(73) Assignee: Her Majesty the Queen in right of Canada, as Represented by the Minister of National Defence, Ottawa, Ontario (CA)

( * ) Notice: Subject to any disclaimer, the term of this patent is extended or adjusted under 35 U.S.C. 154(b) by 1680 days.

(21) Appl. No.: 11/984,635

(22) Filed: Nov. 20, 2007

(65) Prior Publication Data

US 2009/0126059 A1 May 21, 2009

(51) Int. Cl.
*A42B 1/24* (2006.01)

(52) U.S. Cl.
USPC ..... 2/422; 2/6.2; 2/6.6

(58) Field of Classification Search
USPC ..... 2/6.2, 422, 411, 6.4
See application file for complete search history.

(56) References Cited

U.S. PATENT DOCUMENTS

| | | | | | |
|---|---|---|---|---|---|
| 4,293,960 | A | | 10/1981 | Palmaer | |
| 4,453,277 | A | | 6/1984 | Durand et al. | |
| 4,689,836 | A | * | 9/1987 | Vitaloni | 2/424 |
| 4,788,724 | A | * | 12/1988 | Lazzeroni et al. | 2/422 |
| 4,843,642 | A | | 7/1989 | Brower | |
| 4,901,210 | A | * | 2/1990 | Hanabusa | 362/106 |
| 4,996,724 | A | * | 3/1991 | Dextrase | 2/411 |
| 5,465,421 | A | * | 11/1995 | McCormick et al. | 455/344 |
| 5,701,609 | A | * | 12/1997 | Bridges | 2/422 |
| 5,953,761 | A | * | 9/1999 | Jurga et al. | 2/425 |
| 6,009,562 | A | | 1/2000 | Bullock et al. | |
| 6,032,291 | A | * | 3/2000 | Asenguah et al. | 2/171.3 |
| 6,342,872 | B1 | | 1/2002 | Potin et al. | |
| 6,732,381 | B1 | * | 5/2004 | Lal | 2/425 |
| 6,798,392 | B2 | | 9/2004 | Hartwell et al. | |
| 6,970,691 | B2 | * | 11/2005 | Thompson | 455/344 |
| 7,186,159 | B1 | * | 3/2007 | Baxter | 441/124 |
| 7,234,173 | B2 | | 6/2007 | McCalla | |
| 2003/0070200 | A1 | | 4/2003 | Crye et al. | |
| 2003/0196249 | A1 | * | 10/2003 | Roberts | 2/209.13 |
| 2004/0226079 | A1 | * | 11/2004 | Rainey | 2/422 |

(Continued)

FOREIGN PATENT DOCUMENTS

| | | |
|---|---|---|
| DE | 19647631 | 5/1998 |
| DE | 10309107 | 9/2004 |

(Continued)

*Primary Examiner* — Clinton T Ostrup
*Assistant Examiner* — Andrew W Sutton
(74) *Attorney, Agent, or Firm* — Brion Raffoul

(57) ABSTRACT

Systems and devices for protecting a user's head and for integrating accessories with a head protection system. The head protection system uses a rigid shell worn on the user's head and the rigid shell has a power/data bus located inside a preconfigured channel inside a halo housing attached to the shell. This power/data bus is accessible to peripherals using distinct connection points both inside and outside the shell. Removable protection accessories are also provided and attachable to the shell using an attachment subsystem located on the inside edge of the shell. The attachment subsystem has a number of recesses which mate with tabs on the removable protection accessories. Once attached to the shell, the removable protection accessories are lockable into place using a suitable locking mechanism. A nape protection attachment, a mandibular guard attachment, a visor attachment, and other protection accessories may be attached to the shell.

9 Claims, 16 Drawing Sheets

(56) References Cited

U.S. PATENT DOCUMENTS

| | | | | |
|---|---|---|---|---|
| 2006/0026741 | A1 | 2/2006 | Lang-Ree et al. | |
| 2006/0282939 | A1 | 12/2006 | Rogers et al. | |
| 2007/0067894 | A1* | 3/2007 | Bourree et al. | 2/422 |
| 2007/0083967 | A1 | 4/2007 | Crossman et al. | |
| 2007/0214551 | A1* | 9/2007 | Teetzel et al. | 2/422 |
| 2008/0266838 | A1* | 10/2008 | Lin | 362/105 |

FOREIGN PATENT DOCUMENTS

| | | |
|---|---|---|
| EP | 1 459 637 | 9/2004 |
| FR | 2732121 | 9/1996 |
| GB | 773 898 | 5/1957 |
| TW | 253907 B | 5/2006 |
| WO | WO 2005/121689 | 12/2005 |
| WO | WO 2006/081169 | 8/2006 |

* cited by examiner

HEAD PROTECTION SYSTEM

FIELD OF THE INVENTION

The present invention relates to head protection systems such as helmets. More specifically, the present invention relates to a head protection system which has a power/data bus as well as a removable protective accessory mounting subsystem.

BACKGROUND TO THE INVENTION

The search for better and more functional headgear to protect the heads of users engaged in dangerous pursuits has been ongoing for centuries. From the brass helmets of the Roman legionary to the "coal scuttle" helmets of the German soldier of World War I to the Kevlar helmets of the modern American soldier, protective headgear has developed enormously. However, the use of protective headgear need not be limited only to military personnel. Modern-day crash helmets for racecar drivers and helmets for skateboarders and bicyclists also qualify as protective headgear. Not only the design but also the materials used to manufacture such devices has changed enormously over the years. From the steel used to manufacture the helmets of World Wars I and II to the styrofoam used to manufacture skateboarding helmets to the Kevlar used for today's modern combat helmet, protective headgear has changed to provide better and more functional protection for the user.

However, while the material used to manufacture these head protection devices has changed over the centuries, one aspect which has not developed as much has been the functionality of the headgear. For centuries, helmets have been used merely as that—helmets for protecting the user's head. In the past century, protective headgear has evolved to be more than just head protectors. Most people are familiar with the images of the US soldier in Vietnam with containers of plasma or gun oil strapped to his helmet. Also, most people are familiar with the modern day US combat soldier with night vision goggles attached to his helmet along with a boom microphone and headset. In the non-lethal arena, protective headgear for bicyclists now sport miniscule rearview mirrors. This increased functionality of the protective headgear has highlighted a need for ways by which accessories can be attached to the headgear while not impairing the functionality of either the headgear or of the accessories. Current attachment systems tend to be ad hoc in nature may impair the effectiveness of either the headgear or the accessories. As an example, current attachment systems for combat helmets attach accessories on the outside of the headgear, giving an unseemly Christmas tree effect to the soldier's head. As well, accessories which require power and/or data usually have their data and power cables left hanging around the soldier's head. Clearly, such entanglements may affect a soldier's effectiveness.

Also, it should be noted that the majority of protective headgear systems only provide protection to the user's head. In most cases, the user's face, neck, and nape are left exposed. While it might not be advisable to always have protection in these areas, as some headgear protective systems provide, the option of having such protection available to the user would be advantageous.

Based on the above, there is therefore a need for a head protection system which mitigates if not overcomes the deficiencies of the prior art.

SUMMARY OF THE INVENTION

The present invention provides systems and devices for protecting a user's head and for integrating accessories with a head protection system. The head protection system uses a rigid shell worn on the user's head and the rigid shell is provided with a power/data bus located inside a preconfigured channel inside a halo housing attached to the shell. This power/data bus is accessible to peripherals by means of distinct connection points both inside and outside the shell. Removable protection accessories are also provided and may be attached on the shell by way of an attachment subsystem located on the inside edge of the shell. The attachment subsystem has a number of recesses which mate with tabs on the removable protection accessories. Once attached to the shell, the removable protection accessories may then be locked into place using a suitable locking mechanism. A nape protection attachment, a mandibular guard attachment, a visor attachment, and other protection accessories may then be attached to the shell.

In one aspect, the present invention provides a head protection system comprising:

- a rigid shell constructed and arranged to be worn on a user's head, said shell having a front and a back, said shell having at least one mounting point for mountable peripheral devices
- a protective accessory mounting subsystem located on an inside edge of said rigid shell for attaching removable protective accessories to said shell
- a power bus mounted on the inside of a halo housing attached to the outside of said shell, said power bus being accessible to said mountable peripheral devices through said at least one mounting point.

Preferably, the mounting point is a universal hotshoe mounting point. Also preferably, the power bus is a combined power/data bus. Peripheral devices which may be used with the system may include but are not limited to enhanced vision sensors, illumination devices, audio sensors, and laser detectors.

In another aspect of the invention, there is provided a head protection system for use with and attachment to a pre-existing rigid shell constructed and arranged to be worn on a user's head, said shell having a front and a back, the system comprising:

- a halo housing for attachment to a bottom periphery of said shell, said halo housing having a preconfigured channel having a power bus mounted inside said preconfigured channel, said power bus being accessible to mountable peripheral devices through at least one mounting point located on said halo housing;
- a protective accessory mounting subsystem for attachment to an inside edge of said rigid shell, said mounting subsystem being for attaching removable protective accessories to said shell.

BRIEF DESCRIPTION OF THE DRAWINGS

A better understanding of the invention will be obtained by considering the detailed description below, with reference to the following drawings in which.

DETAILED DESCRIPTION

Figure 1:
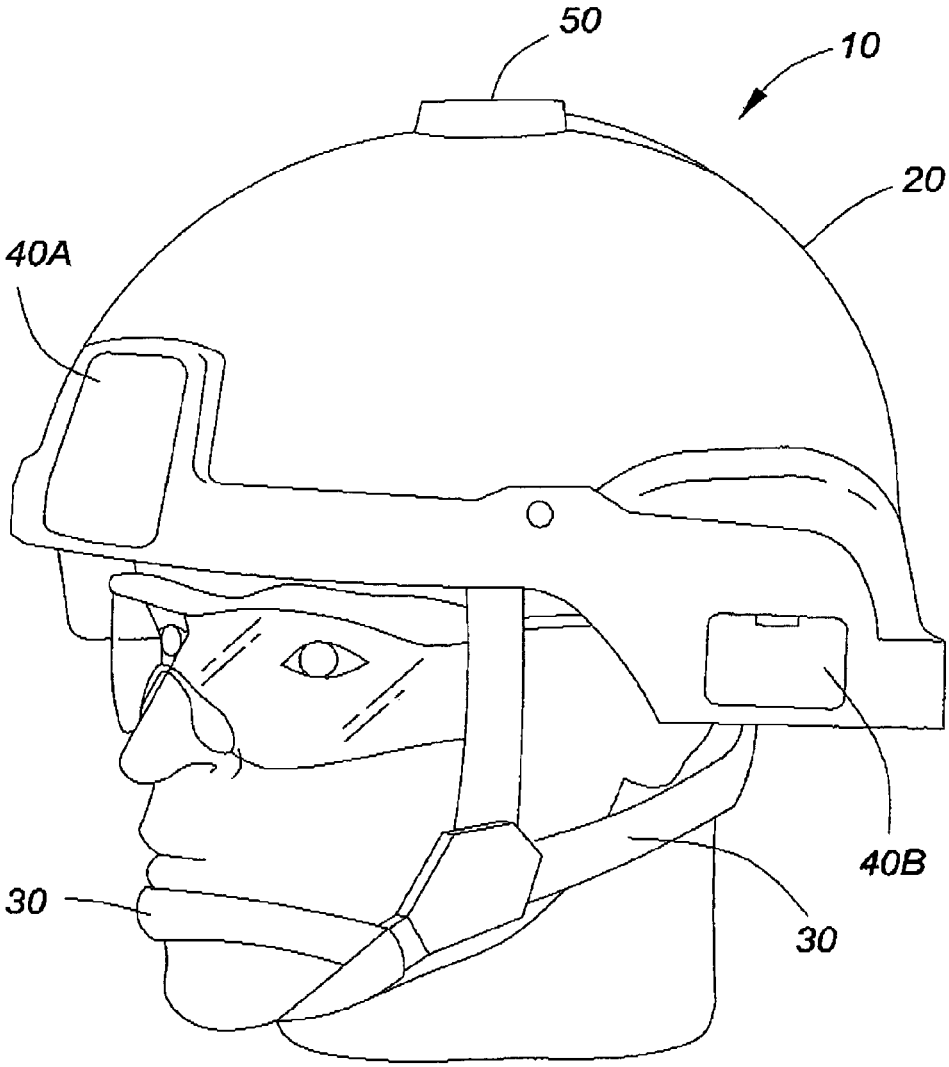
FIG. 1 illustrates a head protection system according to one embodiment of the invention

Referring to FIG. 1, a head protection system 10 according to one aspect of the invention is illustrated. A rigid shell 20 is worn on the user's head. The shell may or may not be secured by straps 30 to the user's head. Mounting points 40A, 40B are located on the outside of the shell for mountable peripheral devices. As can be seen from the figure, the shell 20 has a configuration similar to the Personal Armor System Ground Troops (PASGT) helmet currently used by the US Army in that the shell extends to cover the user's ears and a portion of the user's nape. It should also be noted that, in another embodiment of the invention, the head protection system is provided with a transceiver mounting 50 for a Global Positioning System transceiver or similar navigation/location transceiver.

Figure 2:
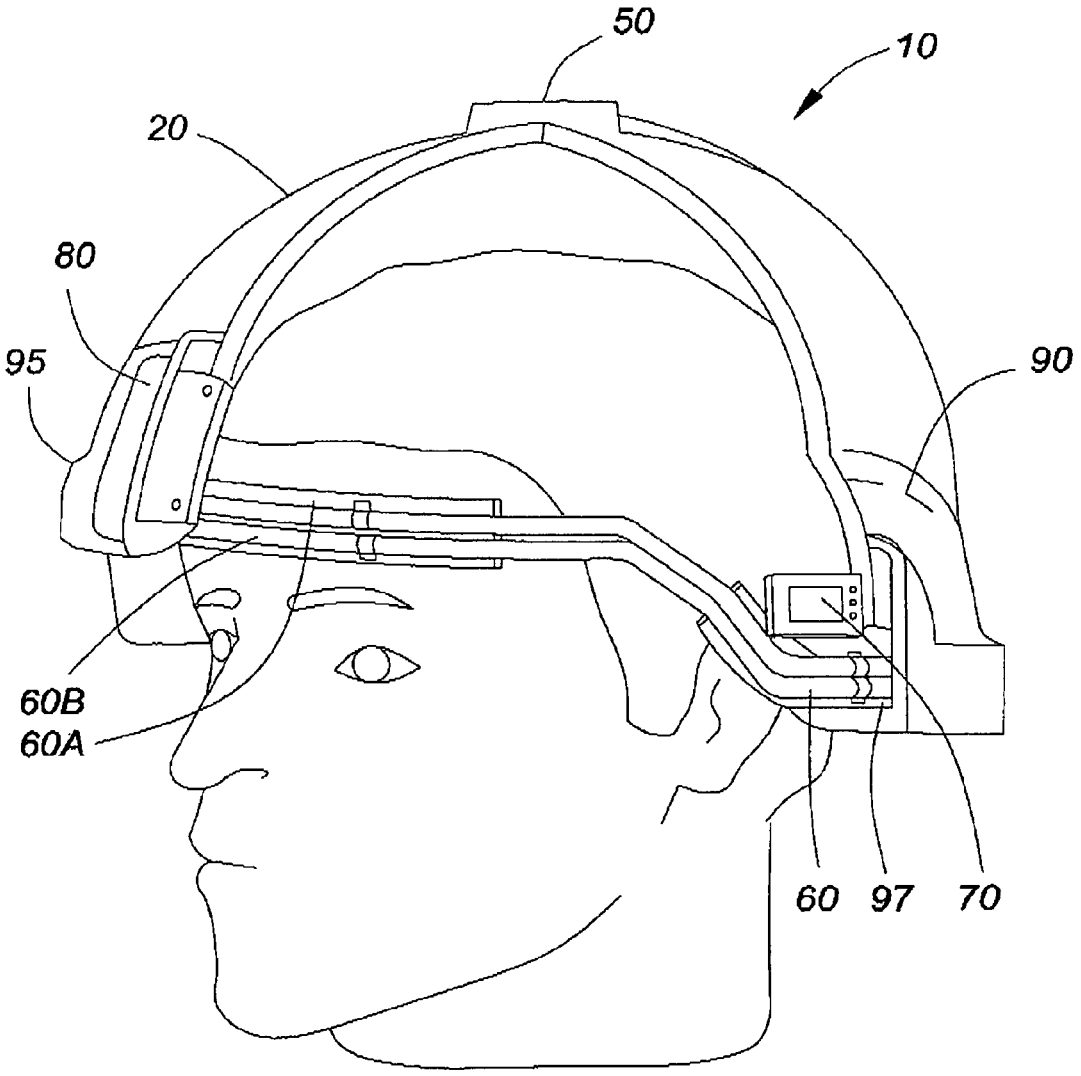
FIG. 2 illustrates a cut-away diagram of the head protection system in FIG. 1

Referring to FIG. 2, a cut-away diagram of the system 10 illustrates the location of a power/data bus 60 inside a preconfigured channel 97 attached to the shell 20. The power/data bus 60 may be separated into a power bus 60A and a data bus 60B. It should be noted that, while the figure illustrates both the power 60A and data 60B buses as being present, embodiments with only a power bus are possible. Depending on the use envisioned for the head protection system 10, a user may not require a data bus but may very well require a power bus to provide electrical power for peripheral devices. FIG. 2 also illustrates that the power/data buses are properly secured inside the preconfigured channel 97 attached to the shell 20. In one embodiment, these buses terminate to an access point (not shown) at the back of the shell 20. Such a terminating access point may be used to couple data processing devices and/or battery packs to the system 10 and thereby to peripherals attached to the system.

As can be seen from FIG. 2, an input/output (I/O) port 70 is provided on at least one side of the system 10. The I/O port 70 may be used as an access point for peripherals to connect to both the power bus and data bus or to only one of these buses. Any suitable plug (such as a Universal Serial Bus (USB) plug or a universal hotshoe plug) may be used with the I/O port to allow numerous peripherals to be used. While only one I/O port is illustrated in the figures, multiple I/O ports may be used in the system. It should also be noted that, as can be seen in the figures, the I/O port may be located at the same location as the mounting point 40B. Locating I/O ports adjacent to or at the same place as mounting points would simplify the coupling of peripherals to the power and data buses. Mounting point 40A may also be provided with an I/O port 80 as illustrated in FIG. 2. The mounting points on the shell 20 may take the form of a universal hotshoe mounting point For convenience and comfort, the I/O ports and the power and data buses may be placed in a compartment 90 located on the left or both left and right sides of the shell (see FIG. 2). The power and data buses may be placed in preconfigured channel adjacent to the edges of the shell.

Figure 3:
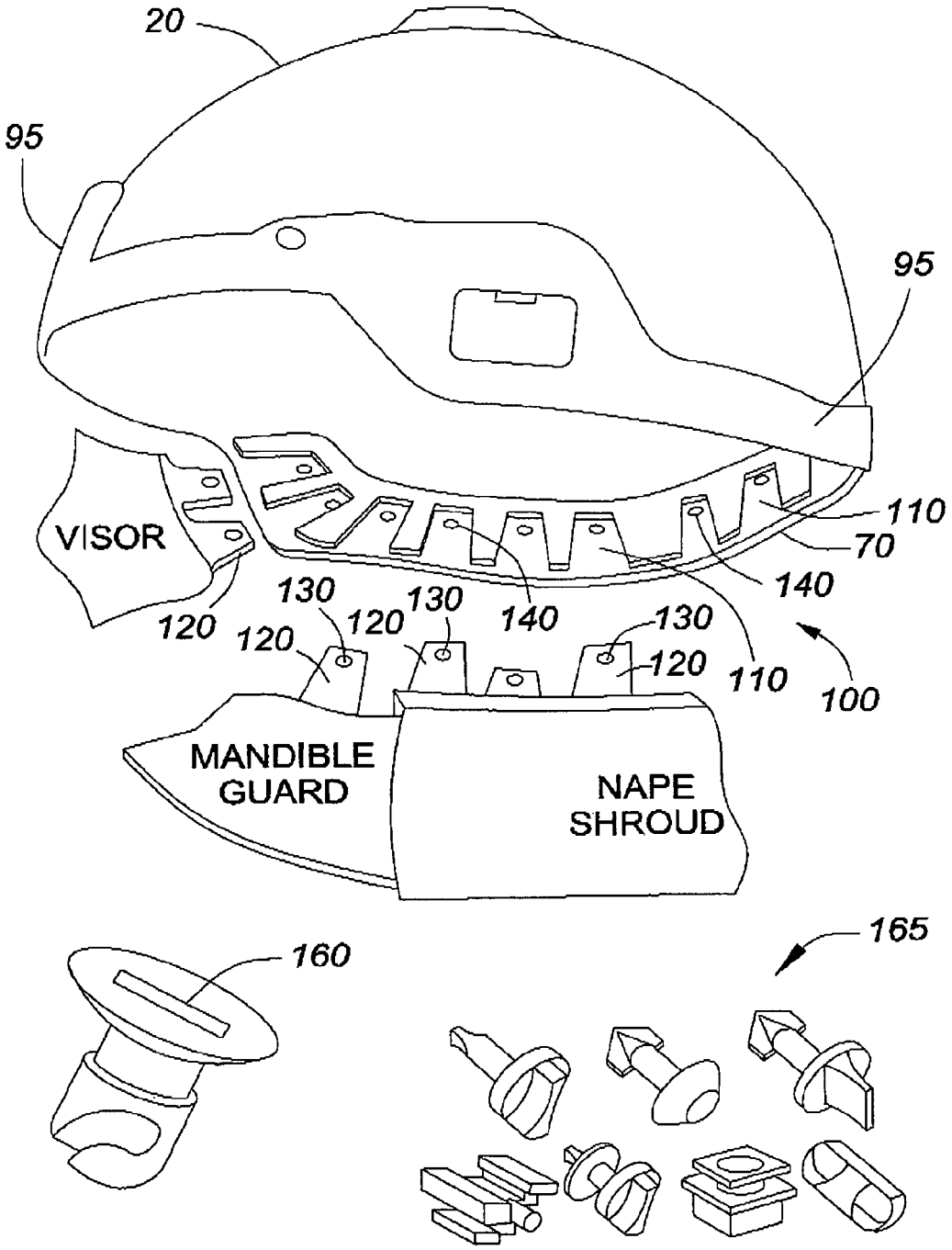
FIG. 3 illustrates a bottom view of the head protection system in FIG. 1 showing the protective accessory mounting subsystem

Referring to FIG. 3, a bottom view of the system 10 is illustrated to show the protective accessory mounting subsystem 100. The subsystem 100 uses a number of recesses 110 located on the inside edge of the shell 20. These recesses 110 are configured to mate with tabs 120 on the protective accessories. In one embodiment, each of the tabs 120 is provided with a hole 130 which corresponds with a protrusion 140 in the recess 110. Once the hole 130 is lined up with the protrusion 140 such that the tab 120 is mated with the recess 110, a fastener 160 is then used to lock the tab into place in the recess. The fastener 160, in this embodiment, is configured to envelop the protrusion 140 and to lock the protrusion with a quarter turn of the fastener. Any suitable detent mechanism may be used to lock the protrusion in the fastener. For the user's comfort, it is preferable that the fastener sits flush with the tab and the edges of the recess. It would also be preferable if the fastener can be rotated without the use of special tools so that any protective accessories may be mounted or removed easily by the user. As can be seen in the figure, the flat head of the fastener and the slot on the head would allow the fastener to sit flush with the tab and would allow the fastener to be removed by using anything which fits in the slot (e.g. flathead screwdriver or a suitably thin coin).

While the above description notes a protrusion in the recess and a fastener to lock the tab in the recess, other locking mechanisms and fasteners 165 may be used. As an example, instead of a protrusion in the recess, a corresponding hole may be used with the fastener being configured as being similar to a screw—the fastener would be inserted into the tab's hole and into the corresponding hole in the recess. The fastener would then be screwed or locked into place with a turn of the fastener to engage a suitable detent mechanism. A person skilled in the art would be able to determine which suitable detent means can be used in the locking mechanism.

Regarding the placement of the compartment 90 and of the preconfigured channels for the power/data buses, these can be placed behind or above the recesses 110 with suitable clearances so that locking in the protective accessories does not interfere with the operation of the power/data bus and of the I/O ports and vice versa. A halo housing 95 on the outside of the shell may be used to house the preconfigured channels so that the power/data buses are not in the user's way. As can be seen, the halo housing encircles the outside bottom periphery of the shell 20.

It should also be noted that the protective accessory subsystem may be used to not only mount protective accessories to cover the back of the user's head but also to mount protective accessories which protect the user's face. For this embodiment, the recesses may be placed at the edge of the shell and may be continued to a point approximately past halfway between the front and the back of the shell. As can be seen in FIG. 3, the recesses open downwards to accommodate protective accessories which would hang down from the shell. However, other recesses 110A, specifically those which are to be used to mount facial protective accessories, would open to the front of the shell.

With the head protection system described above, various configurations are possible. FIGS. 4-16 illustrate various configurations of the system with different protective accessories and peripherals.

Figure 4:
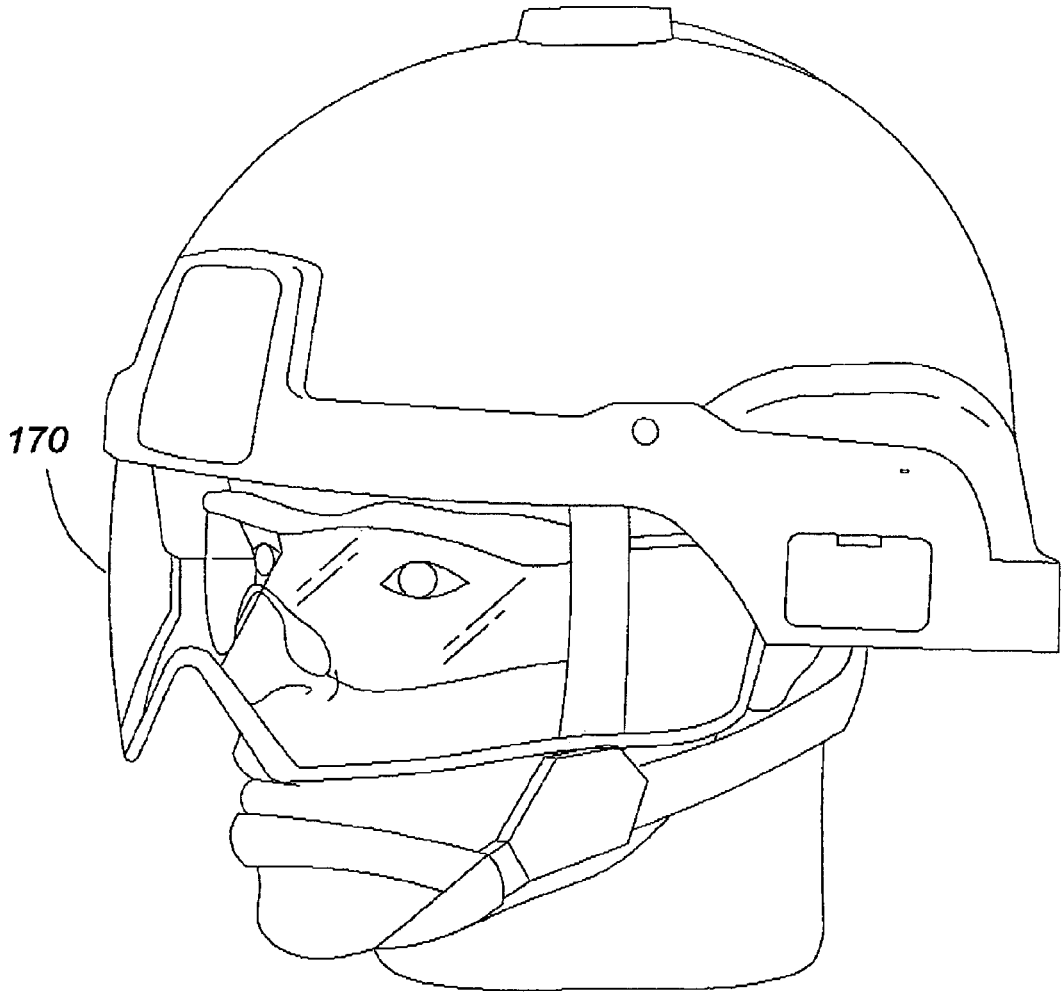
FIG. 4 illustrates the head protection system of FIG. 1 mounting a protective accessory (a fixed visor)

Referring to FIG. 4, the embodiment illustrated has, as a protective accessory, a visor 170. Such a visor would be secured using the forward opening recesses 110A mentioned.

Figure 5:
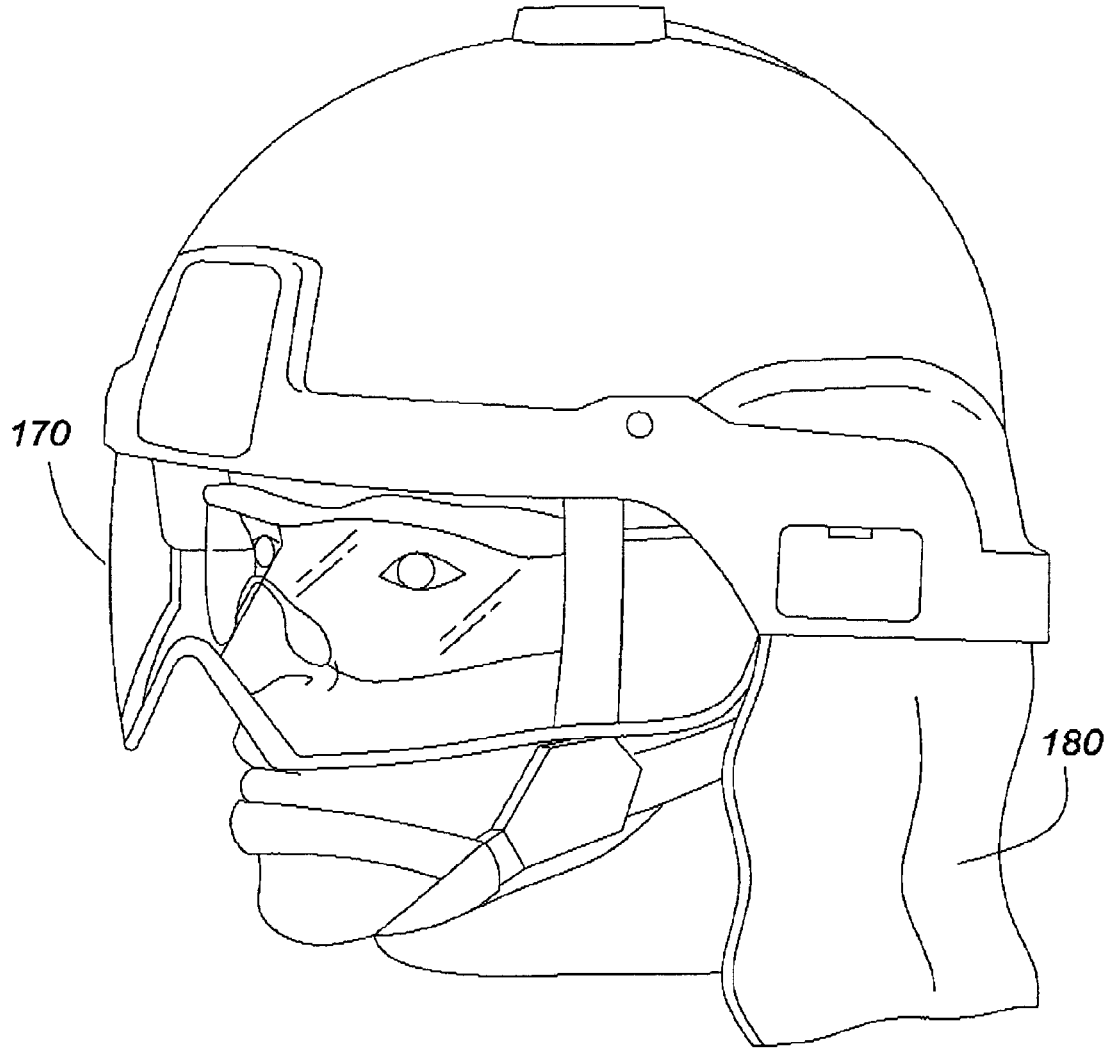
FIG. 5 shows the head protection system of FIG. 4 with a ballistic nape shroud

Referring to FIG. 5, in addition to the visor 170, a ballistic nape shroud 180 is also attached to the shell 20. The ballistic nape shroud would be attached by means of the downward opening recesses 110 mentioned above in relation to FIG. 3. The ballistic nape shroud may be manufactured from various flexible materials suitable for the environment in which the user would be functioning. As an example, if the user is to be deployed in a jungle environment, the shroud may be made of more lightweight material whereas if the user is to be deployed in an arctic environment, a heavier (and hence warmer) material may be used.

Figure 6:
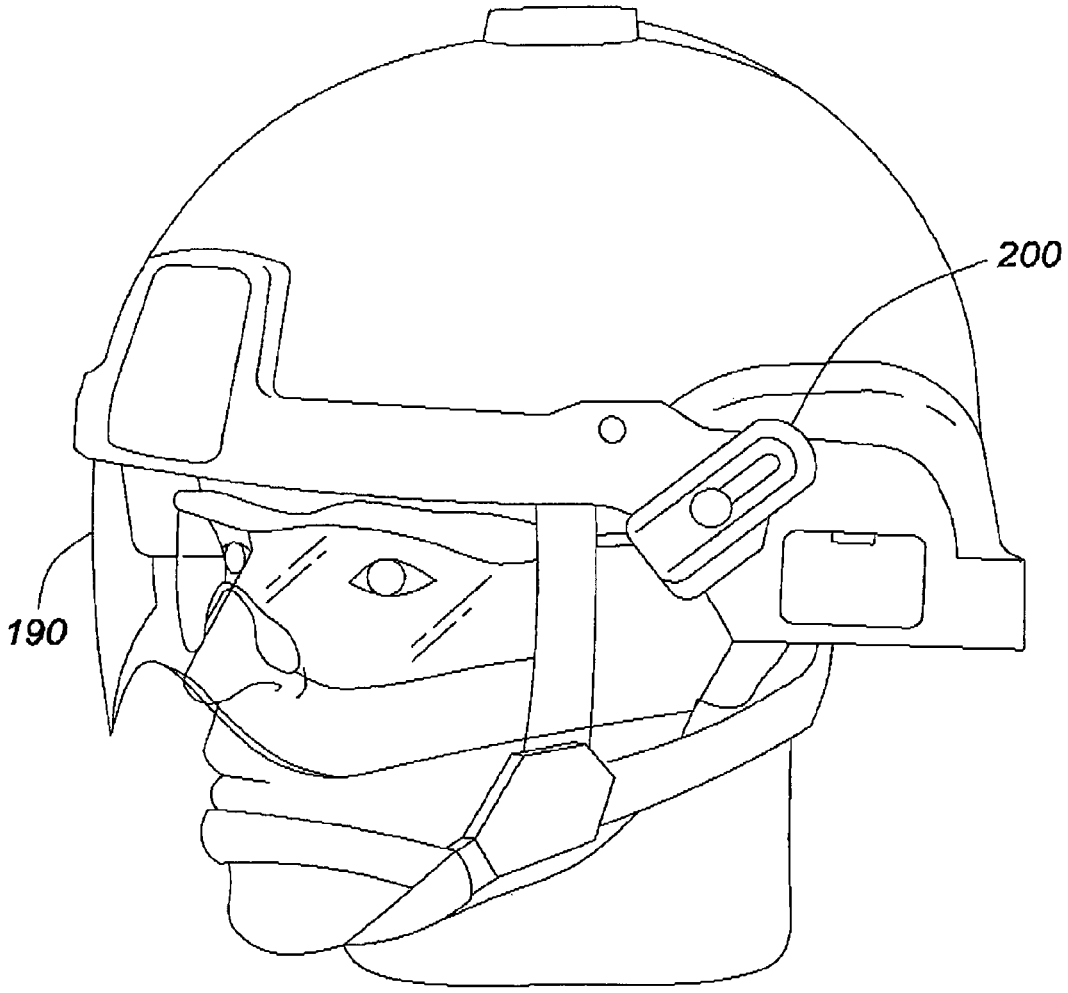
FIG. 6 illustrates the head protection system of FIG. 4 with a flip-up visor attached

Referring to FIG. 6, another type of visor 190 is attached to the shell as a protective accessory. Specifically, the visor 190 is of a flip up variety attached to the outside of the shell. The visor 190 would be secured to a flip-up clip 200 attached to the shell by attaching via the protective accessory subsystem. The clip 200 would attach to the inside of the shell through the forward opening recesses 110A and the visor 190 would attach to the clip.

Figure 7:
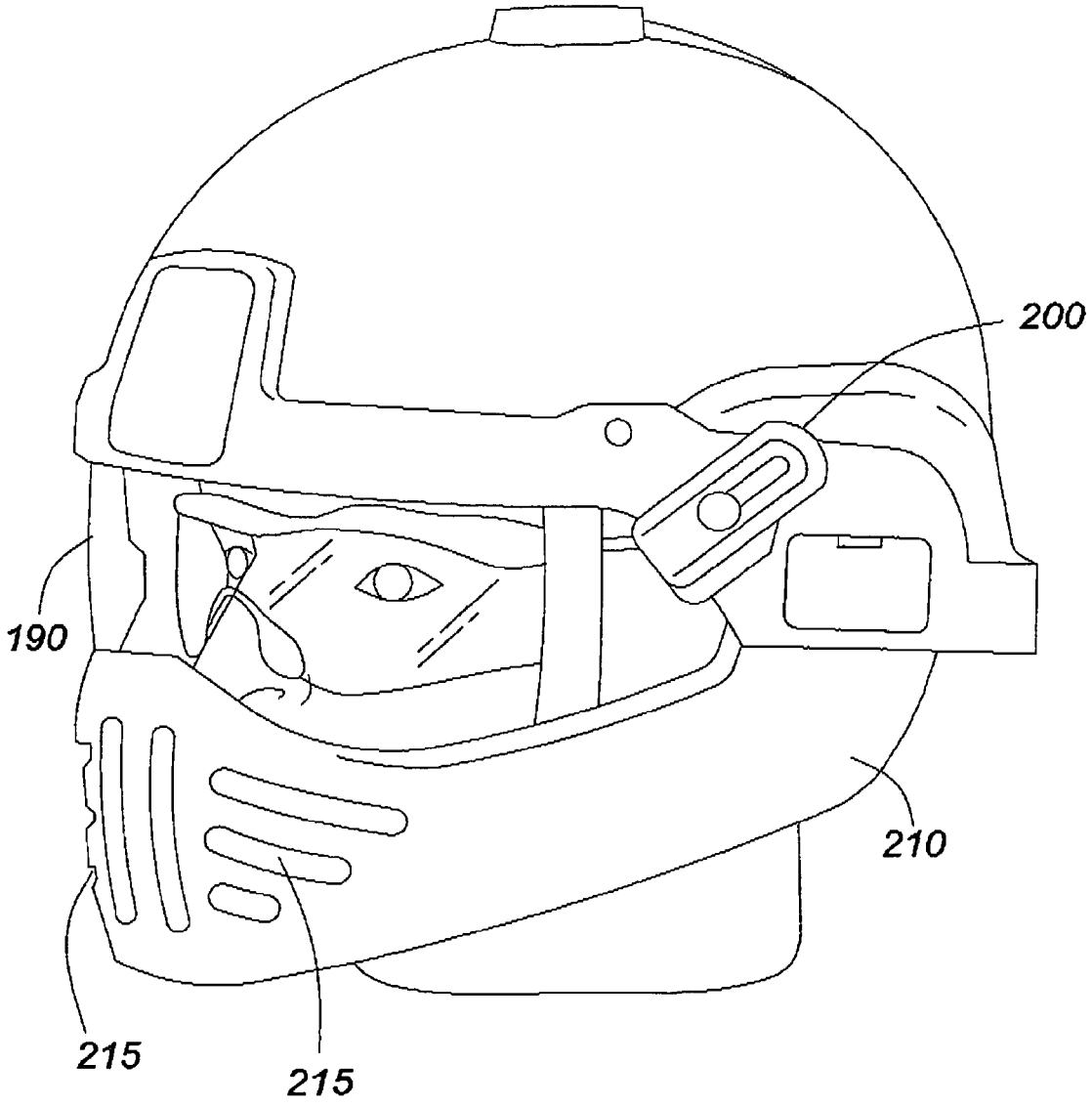
FIG. 7 illustrates the head protection system of FIG. 6 with a mandibular attachment

Referring to FIG. 7, another embodiment of the system 10 is illustrated. In this embodiment, a mandibular protective accessory 210 is used in addition to the flip-up visor 190 and the clip 200. The mandibular accessory 210 attaches to the shell 20 by way of downward opening recesses 110 mentioned above. The flip-up visor 190 and clip 200 attach to the shell as described above. The mandibular accessory attaches to both the left and right sides of the shell and covers the lower portion of the user's face. Preferably, a front section of the mandibular accessory has slits 215 for ventilation purposes. These slits 215 may also be replaced by suitable air passage means such as holes. The mandibular accessory may be constructed from a rigid material and, depending on the projected use, the mandibular accessory may be constructed out of ballistic resistant material such as Kevlar.

Figure 8:
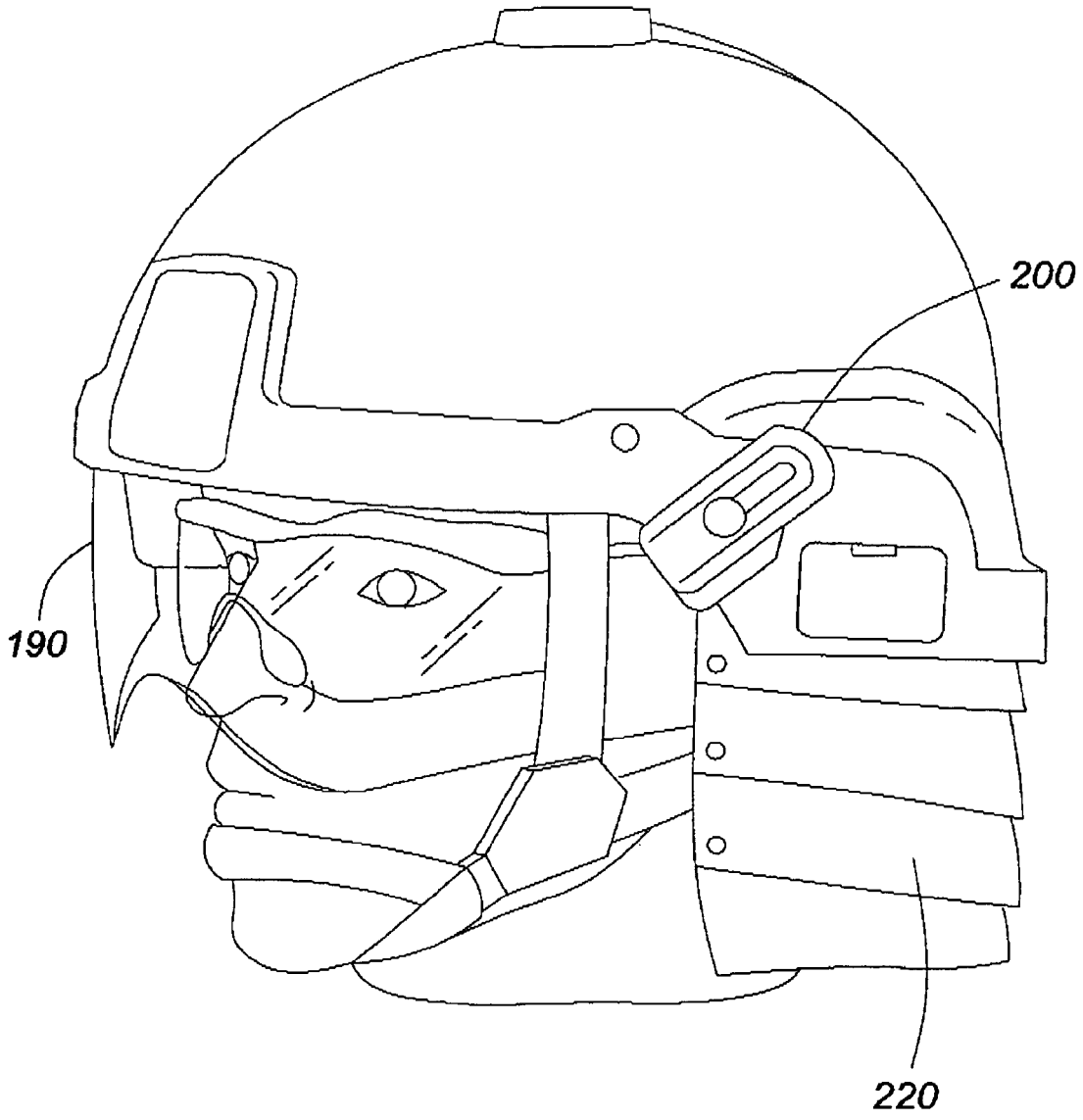
FIG. 8 shows the head protection system of FIG. 1 with a rigid nape shroud and a flip-up visor

In FIG. 8, the embodiment illustrated uses the flip-up visor 190, clip 200, and a rigid nape shroud 220. The rigid nape shroud 220 attaches to the shell by way of the downward opening recesses 110 mentioned above. It should be noted that the rigid nape shroud 220 is removably attachable to the shell. The shroud is constructed of a number of curved sections or plates of rigid material flexibly attached to one another longitudinally with each section overlapping its immediately adjacent section. This configuration of the shroud provides flexibility while providing protection to the user's nape. The sections may, for better protection against projectiles, be constructed out of ballistic resistant material such as Kevlar.

Figure 9:
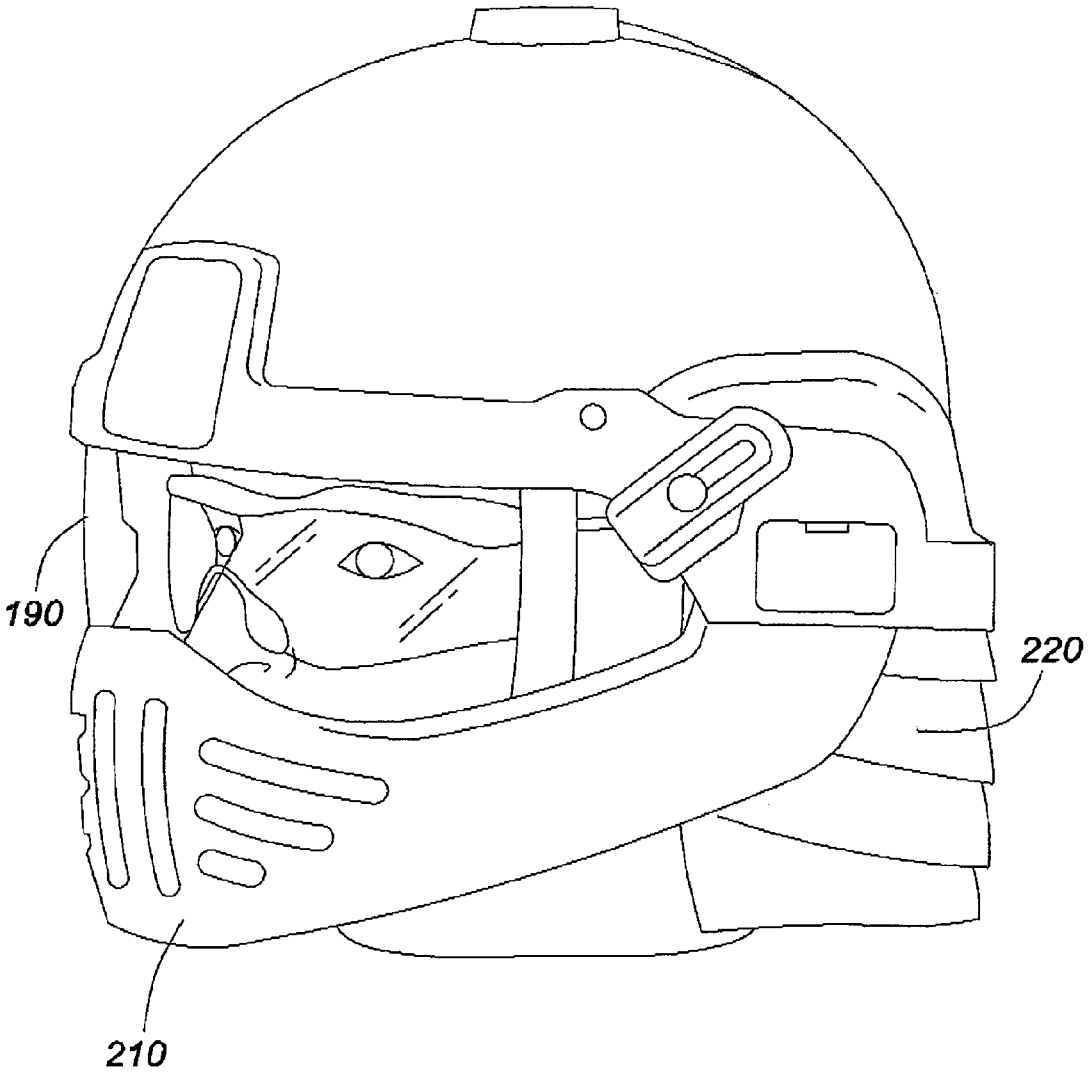
FIG. 9 illustrates the head protection system of FIG. 8 with a mandibular attachment

Referring to FIG. 9, the embodiment illustrated deploys the flip-up visor 190, the mandibular accessory 210, and the rigid nape shroud 220. These accessories are attached to the shell 20 as described above.

Figure 10:
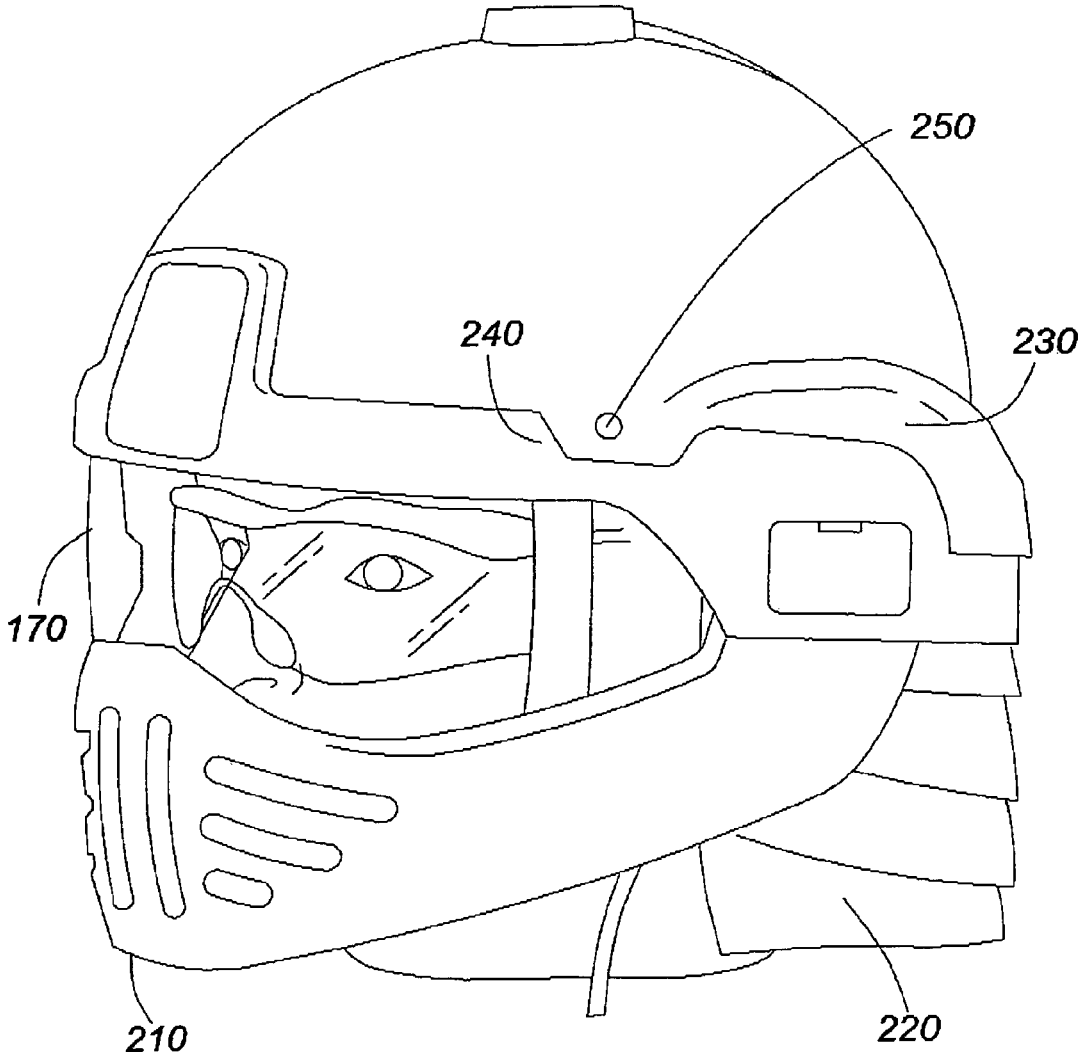
FIG. 10 illustrates the head protection system of FIG. 1 with a mandibular attachment, a rigid nape shroud, a fixed visor and a hardened armour cap

The embodiment in FIG. 10 is identical with the embodiment in FIG. 9 with the exception that a hardened armor cap 230 is placed on top of the shell 20 and a fixed visor 170. The hardened armor cap 230 is removable and would provide more protection to the user's head against projectiles such as bullets and shrapnel. Clearly, the hardened armor cap 230 would be constructed of harder or at least more protective material than the shell 20. The hardened armor cap 230 may be attached to the shell 20 by way of an overlapping lip 240 and a suitable clip 250.

Figure 11:
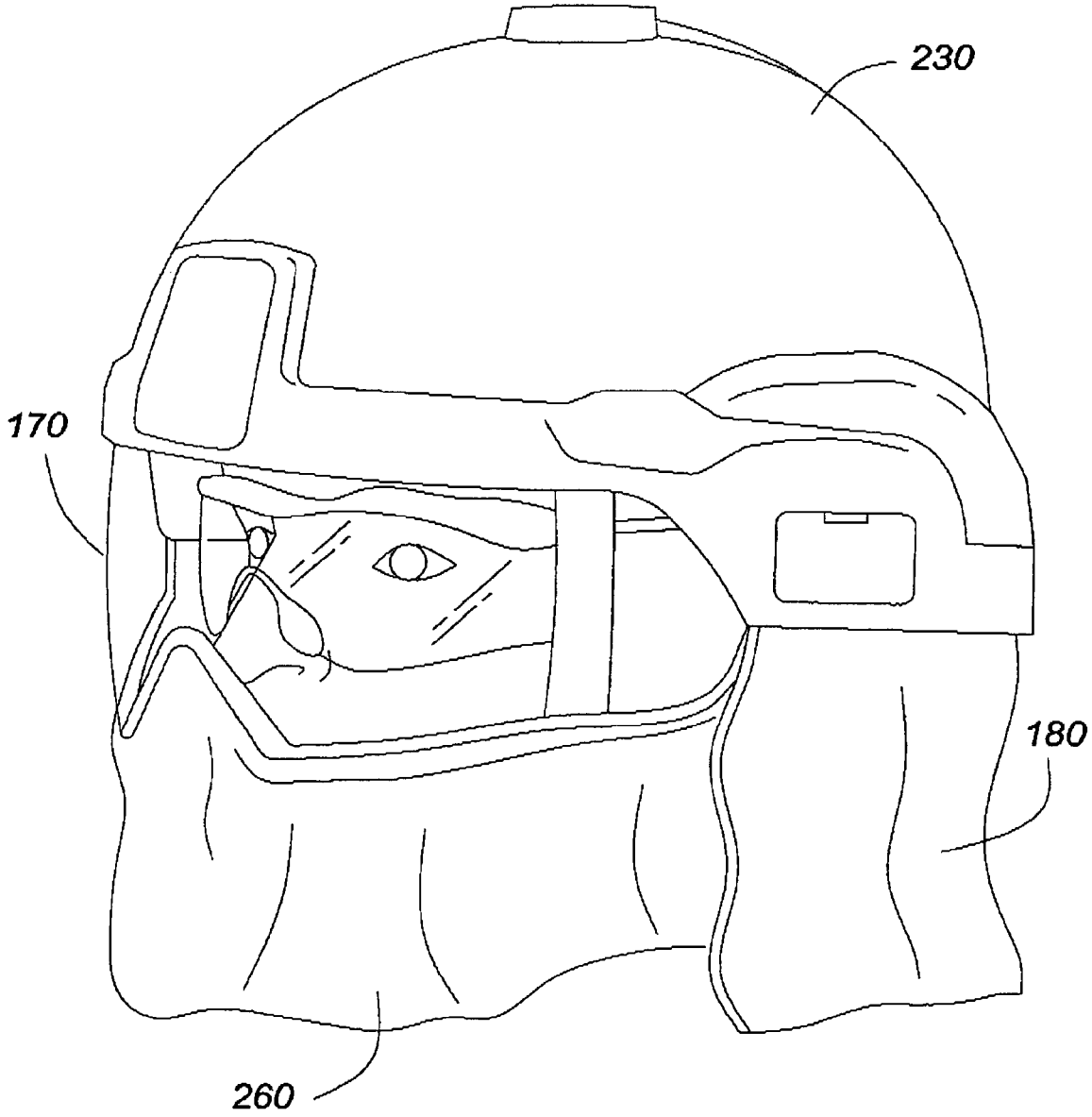
FIG. 11 shows the head protection system of FIG. 10 with a mandibular shroud and a ballistic nape shroud

If the user is to be deployed to a desert environment, the embodiment in FIG. 10 may be modified to prevent sand and other particles from irritating the user's face. In FIG. 11, the mandibular accessory 210 is not shown but is covered by a mandibular shroud 260 while the rigid nape shroud is covered by the ballistic nape shroud 180. The ballistic nape shroud 180 may be attached by placing two tabs (one from the rigid nape shroud and one from the ballistic nape shroud) in each recess. By doubling up on the attachments for the protective accessory mounting subsystem, multiple accessories may be placed so as to overlap one another. The mandibular shroud may be attached to the shell in a similar manner and may be attached to the mandibular accessory by any suitable means known to a person skilled in the art. It should be noted that the mandibular shroud may be constructed out of flexible ballistic projectile material. As such, the mandibular shroud may function as ballistic soft armor.

Figure 12:
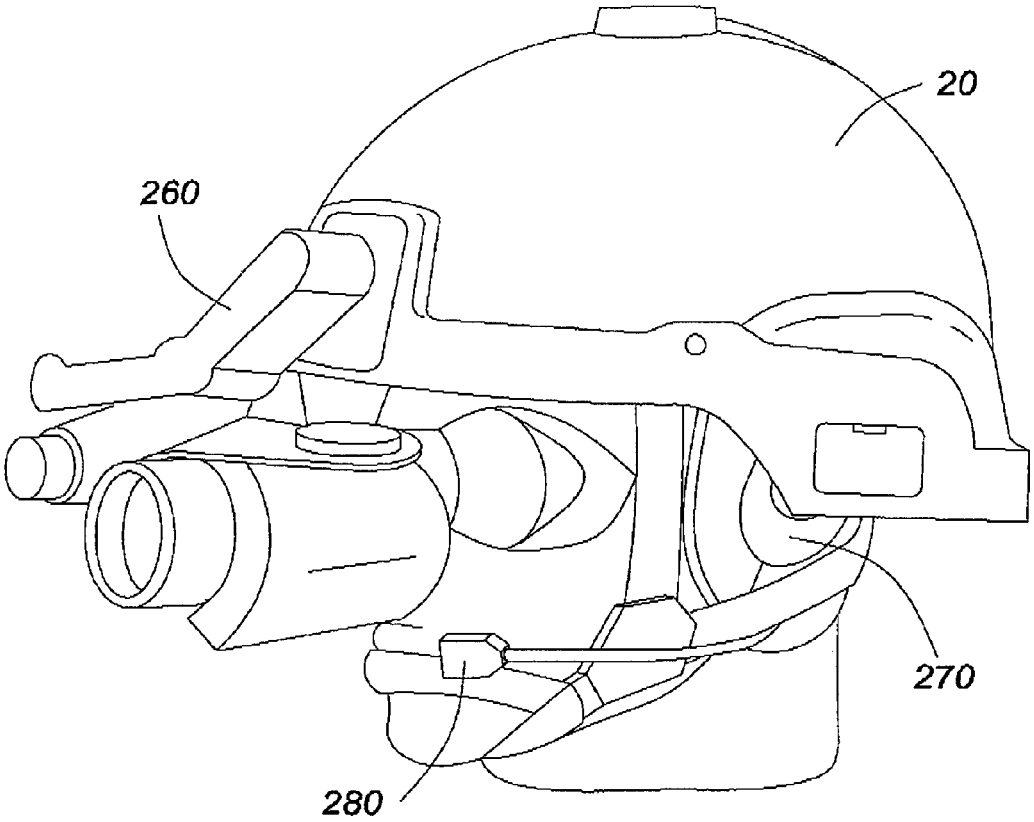
FIG. 12 illustrates the head protection system of FIG. 1 with a vision enhancement device attached

Referring to FIG. 12, another embodiment of the system 10 is illustrated. This embodiment uses night vision goggles 260 attached to the shell 20 by way of mounting point 40A. The night vision goggles 260 may be configured to receive power from the power bus by way of an I/O port located adjacent to the mounting point 40A. As part of this embodiment of the system 10, there is also provided a headset 270 and boom microphone 280. The headset 270 may be coupled to the data/power bus by way of an I/O port (not shown) located on the inside of the shell 20. The boom microphone 280 is coupled to the headset 270. It should be noted that other types of vision enhancement devices like the night vision goggles may be attached to the shell 20. By way of example and without limiting the scope of what may be used with the invention, thermal viewing devices and fusion sensor devices may be used.

Figure 13:
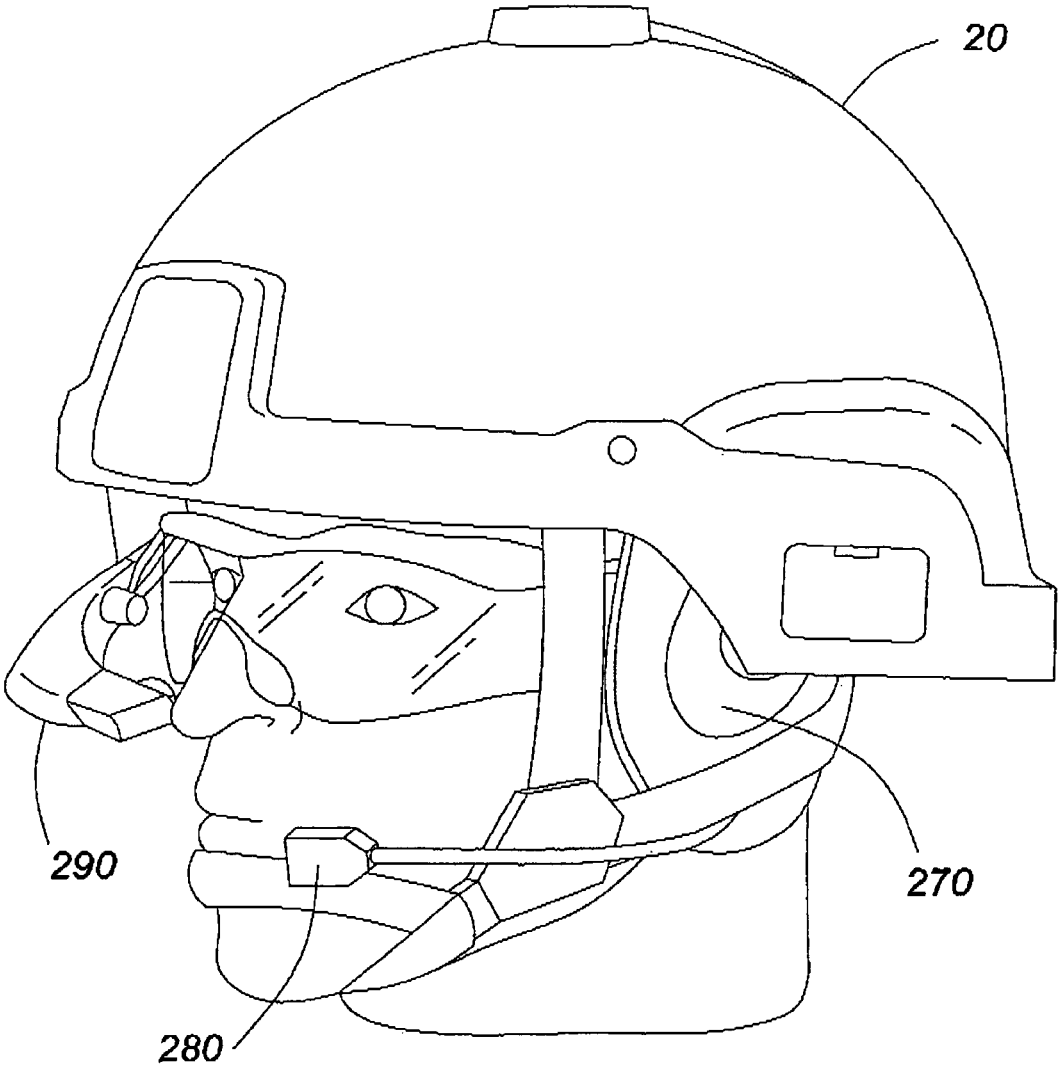
FIG. 13 illustrates the head protection system of FIG. 1 with a helmet mounted display and a headset and microphone

The embodiment in FIG. 13 is similar to the embodiment in FIG. 12 with the exception that, instead of night vision goggles, a helmet mounted display 290 is attached to the shell 20. The display 290 is coupled to the power/data bus by way of one of the I/O ports, adjacent to one of the mounting points.

Figure 14:
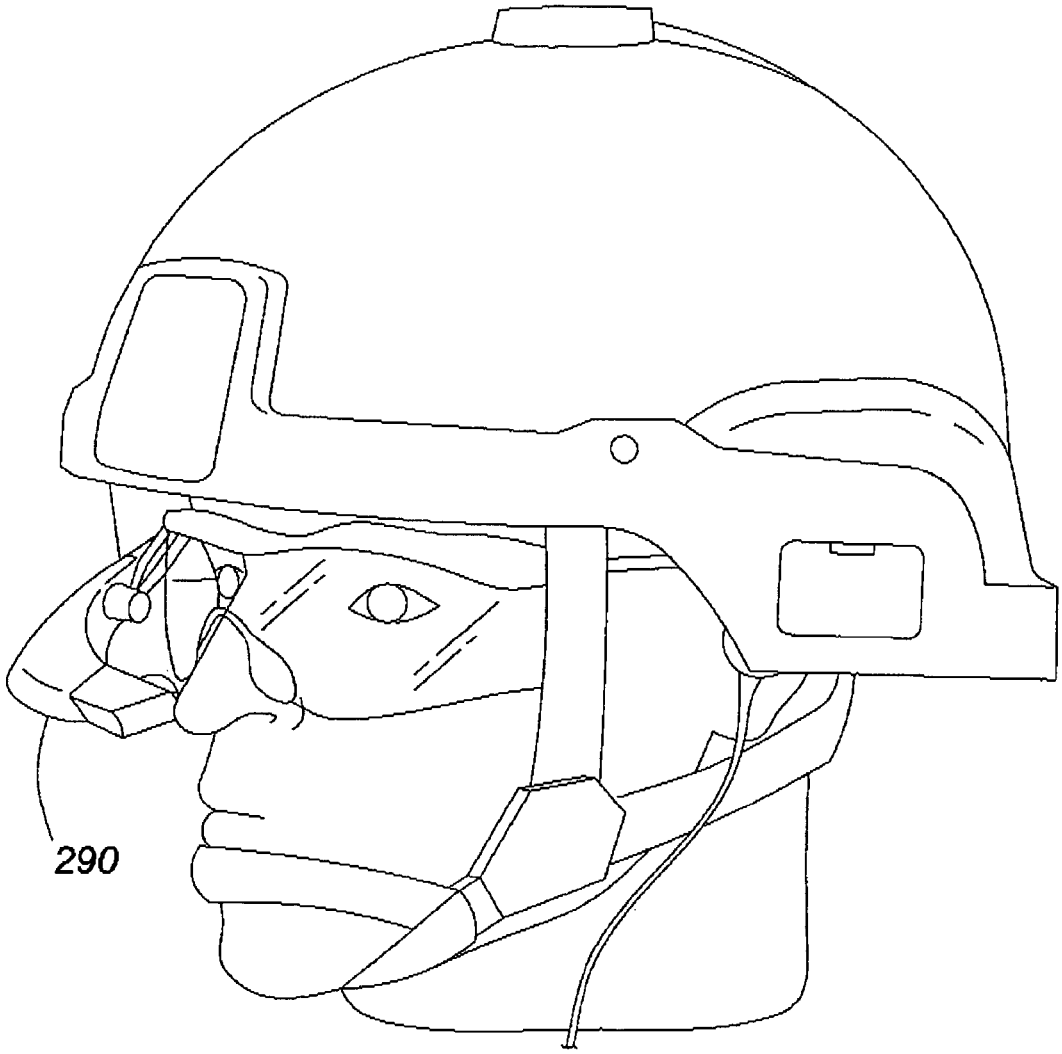
FIG. 14 shows a similar embodiment to FIG. 13 but with a different type of headset and microphone.

In FIG. 14, a similar embodiment to that in FIG. 13 is illustrated. Instead of separate headset and boom microphones, a combined in-ear microphone and earphone is used. Such a combined device is similar to headsets used for modern-day cellular telephones and their associated in-ear communication devices. It should be noted that the in-ear microphone and earphone in FIG. 14 is separately wired to a communications device and is not coupled to the power/data bus which is part of the system 10.

Figure 15:
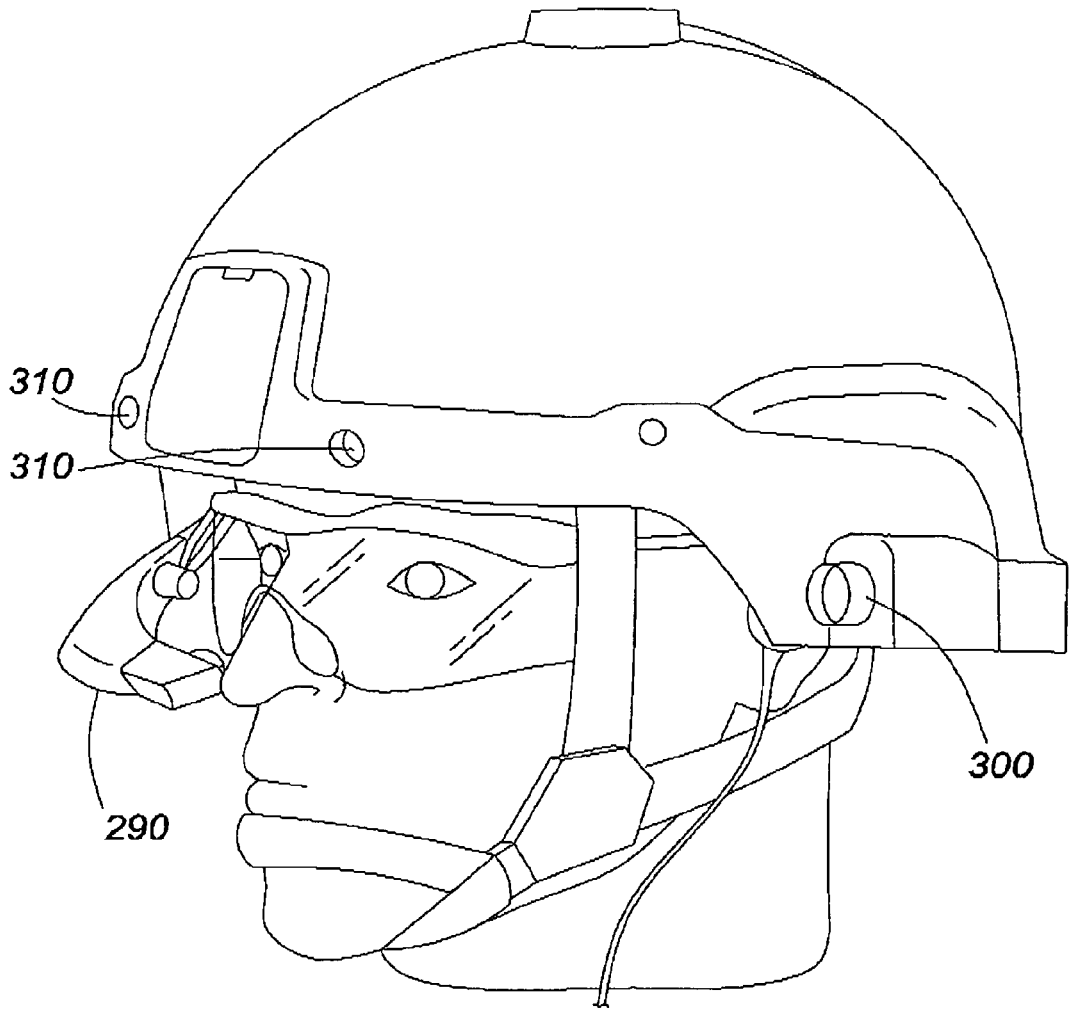
FIG. 15 illustrates the system of FIG. 14 with added illumination devices

For the embodiment in FIG. 15, the combined in-ear microphone and earphone is used along with the helmet mounted display 290. Also used in this embodiment are a removable illumination device 300 and an integrated illumination device 310. The removable illumination device 300 is attached to the shell by way of mounting point 40B and receives power by way of an I/o port adjacent to the mounting point. The integrated illumination device 310 is integrated into the shell 20. In one embodiment, such an integrated illumination device 310 may be light emitting diodes (LEDs) set into a brow section of the shell 20. The LEDs may be embedded in the halo housing 95 attached to the shell 20. Such integrated illumination devices 310 would receive power by being directly coupled to the power bus. It should be noted that either of the illumination devices may provide white or infrared (IR) illumination depending on the use contemplated by the user. As an example, the removable illumination device may provide IR light while the integrated illumination devices may provide white light.

Figure 16:
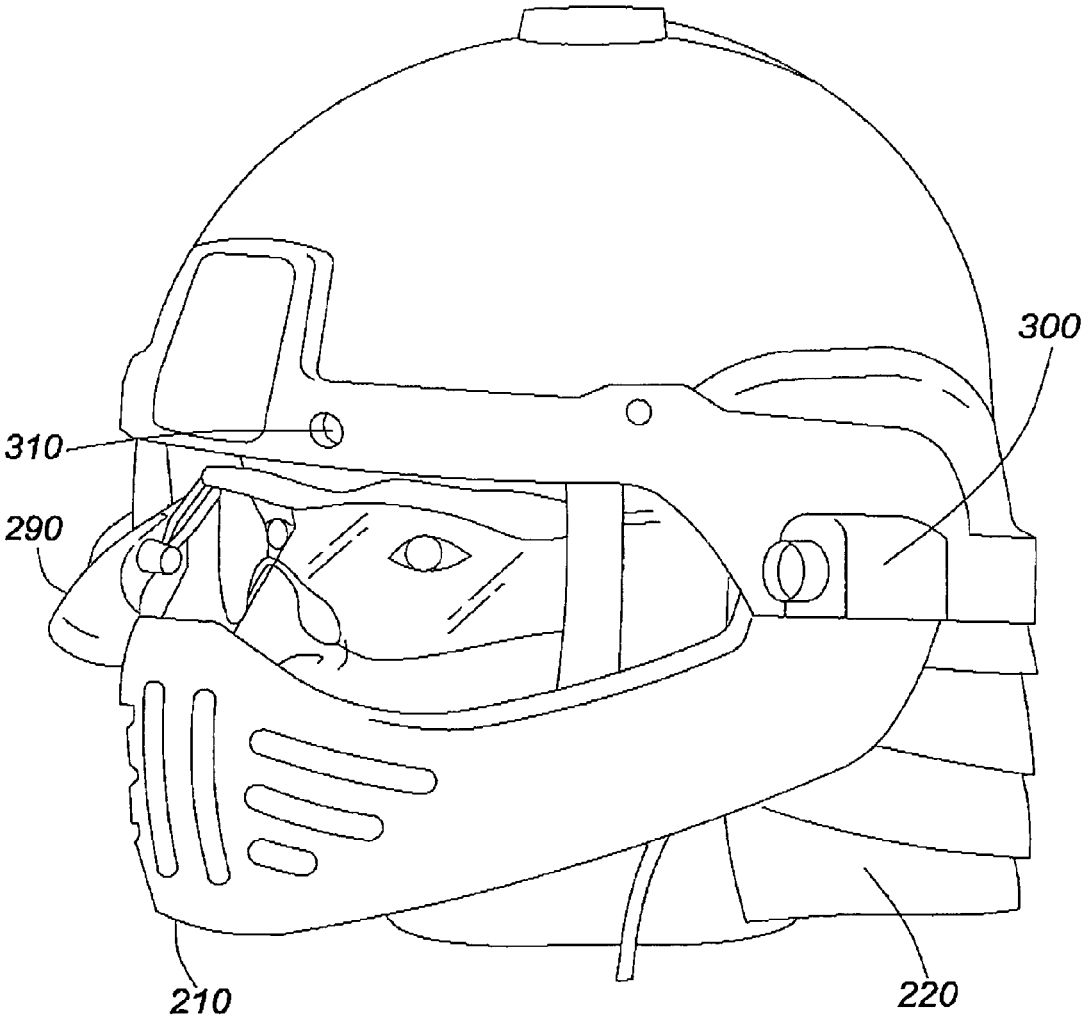
FIG. 16 illustrates the system of FIG. 15 with a mandibular attachment and a rigid nape shroud.

Referring to FIG. 16, the embodiment illustrated utilizes the integrated illumination device 310, the removable illumination device 300, and the helmet mounted display 290. Also utilized are the mandibular accessory 210 and the rigid nape shroud 220. These protective accessories may be attached to the shell as described above.

It should be noted that the head protection system described above may be implemented as a combat helmet system for use by combat personnel. The shell may be manufactured from a hard, rigid material such as some types of plastic. The hard armour cap may be manufactured from projectile resistant material such as Kevlar or some types of metal.

It should further be noted that the head protection system may be implemented as an add-on to a pre-existing combat helmet to enhance that combat helmet's capabilities. As an example, the halo housing, the protective accessory mounting subsystem, and compartment housing the I/O ports and the power/data buses may be constructed as a single add-on piece. The add-on may then be added to a pre-existing combat helmet and, by doing so, provide the user with the enhanced functionality that the system provides without sacrificing the efficiency or the integrity of the helmet. It should be noted that the add-on piece may be unitarily constructed or be capable of assembly from a number of parts to form a single whole.

A person understanding this invention may now conceive of alternative structures and embodiments or variations of the above all of which are intended to fall within the scope of the invention as defined in the claims that follow.

We claim:

1. A head protection system for use with an attachment to a pre-existing rigid shell constructed and arranged to be worn on a user's head, said shell having a front and a back, the system comprising:

a halo housing for attachment to a bottom periphery of said shell, said halo housing having a preconfigured channel having a power bus mounted inside said preconfigured channel, said power bus being accessible to mountable peripheral devices through at least one mounting point located on said halo;

a protective accessory mounting subsystem for attachment to an inside edge of said rigid shell, said mounting subsystem being for attaching removable protective accessories to said shell;

wherein when said protective accessory mounting subsystem is attached to said rigid shell, said mounting subsystem comprises:

a plurality of recesses located on an inside edge of said shell, each one of said plurality of recesses being configured to mate with a tab on a removable protective accessory, each one of said plurality of recesses having a protrusion for mating with a corresponding hole on said tab such that said tab, after being mated with said recess, is lockable in said recess with a fastener; and said pre-existing rigid shell is a combat helmet and said removable protective accessories physically protect said user.

2. A head protection system according to claim 1 wherein said protective accessory mounting subsystem extends to a section of said shell halfway between said front and back of said shell, said subsystem being also for mounting removable protective accessories which extend to said front of said shell.

3. A head protection system according to claim 1 further including a data bus adjacent said power bus and mounted inside said preconfigured channel, said data bus being accessible to said mountable peripheral devices through said at least one mounting point.

4. A head protection system according to claim 1 wherein said removable protective accessories comprises a mandibular accessory for covering a lower front of said user's face.

5. A head protection system according to claim 1 wherein said removable protective accessories comprises a rigid nape shroud.

6. A head protection system according to claim 1 wherein said removable protective accessories comprises a visor for covering an upper front of said user's face.

7. A head protection system according to claim 5 wherein said rigid nape shroud comprises a plurality of plates of rigid material, each plate of rigid material being flexibly attached longitudinally to an immediately adjacent plate.

8. A head protection system according to claim 1 wherein said removable protective accessories comprises a ballistic nape shroud, said ballistic nape shroud being constructed of flexible material.

9. A head protection system according to claim 1 wherein said mountable peripheral devices comprises at least one of:

headset;

microphone;

vision enhancement devices;

helmet mounted display; and illumination devices.

* * * * *